United States Patent [19]

Vogt et al.

[11] Patent Number: 4,531,027

[45] Date of Patent: Jul. 23, 1985

[54] "JOY-STICK" AND ROCKER SWITCH CONTROL MECHANISM

[75] Inventors: James L. Vogt; Michael J. Verhulst, both of Ottumwa, Iowa

[73] Assignee: Deere & Company, Moline, Ill.

[21] Appl. No.: 626,369

[22] Filed: Jun. 29, 1984

[51] Int. Cl.[3] ..... H01H 25/04

[52] U.S. Cl. ..... 200/6 A; 200/153 K

[58] Field of Search ..... 200/6 A, 153 K, 339; 74/471 XY

[56] References Cited

U.S. PATENT DOCUMENTS 4,161,726 7/1979 Burson et al. ..... 200/6 A

*Primary Examiner*—A. D. Pellinen

*Assistant Examiner*—Morris Ginsburg

*Attorney, Agent, or Firm*—Henderson & Sturm

[57] ABSTRACT

Control mechanism employing a "joy-stick" unit in conjunction with electrical rocker switches, featuring a mounting bracket secured to the joy-stick unit and carrying a pair of rocker switches. The angularly movable elements of the unit are transmitted to the switches by hairpin-like "shafts" having legs engaging the faces of the respective switches.

10 Claims, 3 Drawing Figures

"JOY-STICK" AND ROCKER SWITCH CONTROL MECHANISM

BACKGROUND OF THE INVENTION

Several forms and types of "joy-stick" controls are known in the art; that is, a control in which a lever is mounted for multi-directional movement to control a plurality of functions or to obtain any one of several results. Such controls are found in many fields; e.g., agricultural, industry, automotive, etc. In a typical situation, the joy-stick may be moved in, say, East-West directions to obtain right-left movements of a remote instrumentality and North-South for effecting, say, forward-reverse movement of the instrumentality. The joy-stick is also typically tied into intermediate means such as hydraulic, electric, etc. valves, switches etc. The basic thrust of the present invention is to utilize a joy-stick unit of known constructron in combination with electrical switches by means of providing a unique mounting element for containing the switches and novel actuating means for operating the switches selectively according to movement of the joy-stick.

BRIEF DESCRIPTION OF THE INVENTION

Since the end use of the invention according to the present application is not a limiting factor, the invention will be described in terms of its related components without regard to the end results to be obtained. In a preferred form of the invention a joy-stick unit of known construction is used in combination with a pair of electrical rocker switches also of known construction, the combination being effected by a mounting element that mounts the switches on the base of the joy-stick for operation by driven members connected to the driving members of the joy-stick unit. In the present case, the joy-stick unit selected is manufactured by the O.E.M. Company of Shelton, Conn. It is oriented in the present case with the joy-stick lever in a normal upright position and has a bottom at which two independently controlled driving members are mounted for back and forth angular movement respectively about upright axes according to movement of the lever. A mounting element of inverted U-shape is secured to the bottom of the base and has depending wall portions, each of which carries a rocker switch. A pair of driven members, one for each rocker switch, is connected respectively to the driving members and arranged to rock the rocker switches. Each driven member is in the form of a "hairpin" of resilient steel wire or the like, having an upper end portion in the form of a bight which is inserted into the square socket of a driving member. The legs of the hairpin depend respectively along opposite faces of the rocker switch for rocking same when the associated driving member is moved by the joy-stick. The invention features simple mounting of the rocker switches in a compact unit, especially in vertically overlapping and offset relation so they nest within the walls of the inverted U-shaped mounting element. The element and joy-stick unit are easily assembled and disassembled for ease in production, repair and maintenance. Further features and objects of the invention will appear as a preferred embodiment thereof is disclosed in detail in the ensuing description and accompanying drawings.

DETAILED DESCRIPTION OF THE INVENTION

Figure 1:
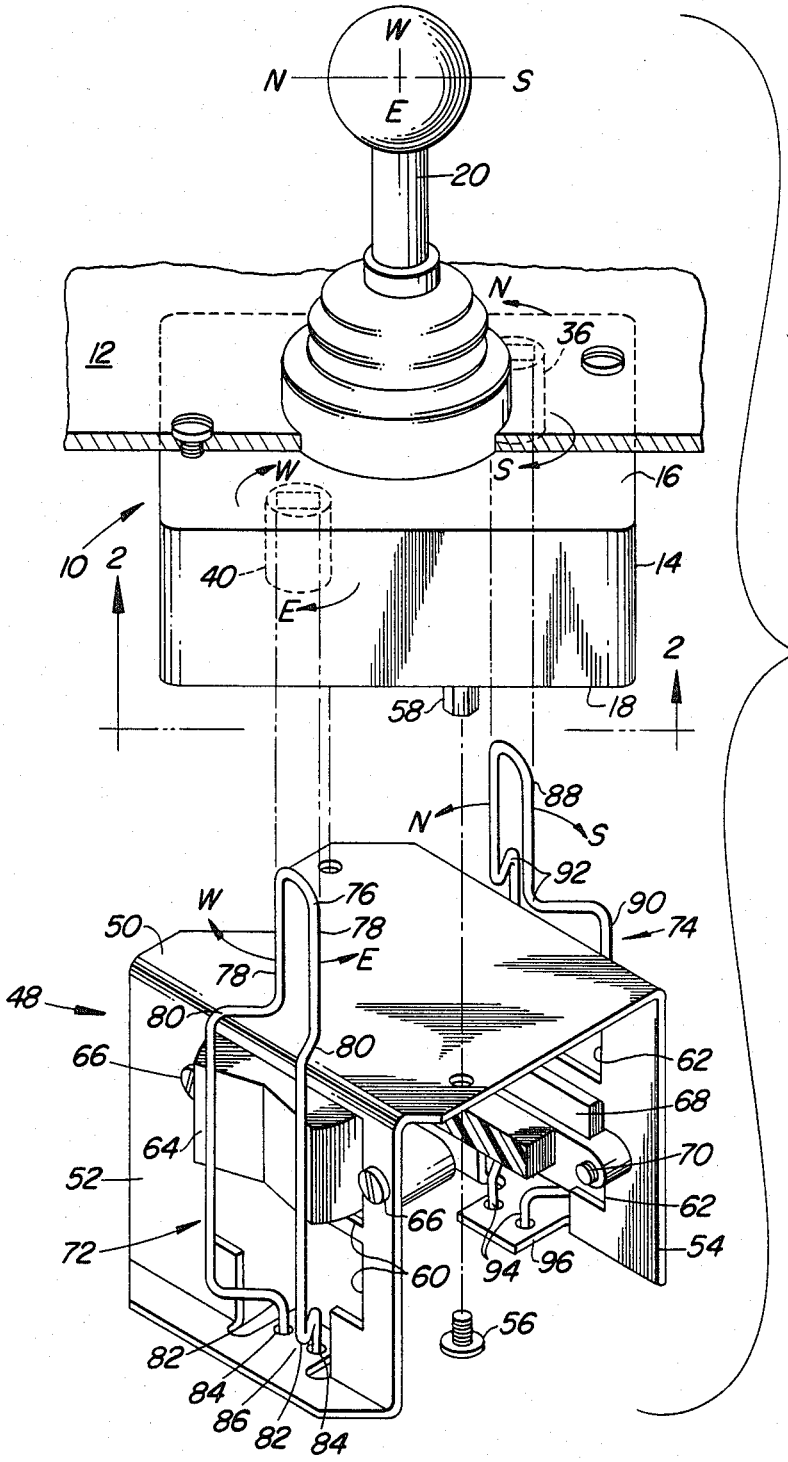
FIG. 1 is an "exploded" perspective of the basic components of the invention.

Reference will be had first to FIG. 1 for a general overview of the construction and design. In that Figure, the numeral (10) designates the joy-stick unit as being vertically oriented and carried by a suitable support (12). The unit (10) has a base (14) which includes a top (16) and a bottom (18) and a joy-stick lever (20) which is ball-mounted at (22) (FIG. 3) for multi-directional movement, here designated E-W and N-S, for East-West and North-South, respectively. Any other designation may be used according to the functions, results, etc. sought to be accomplished, which are of little moment here. Because of the ball mounting, the lever may of course have movement partaking of combinations of E-W and N-S directions, as upon movement of the lever diagonally.

Figure 3:
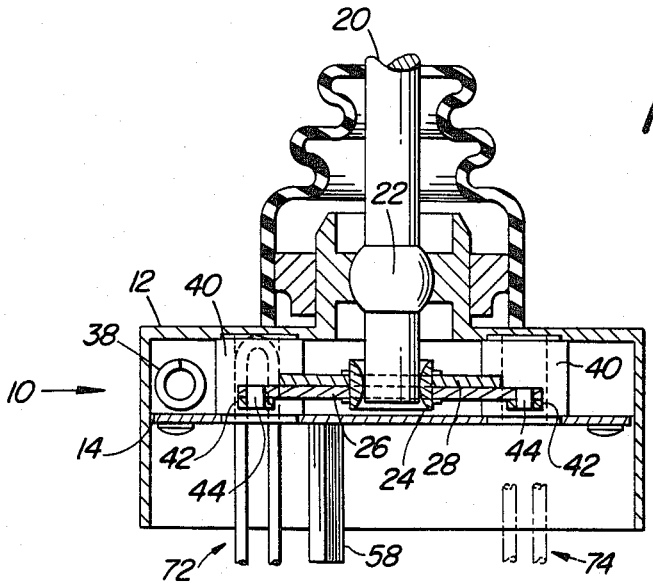
FIG. 3 is a section on the line 3—3 of FIG. 2 with the position of an omitted part being indicated by dot-dash lines.
Figure 2:
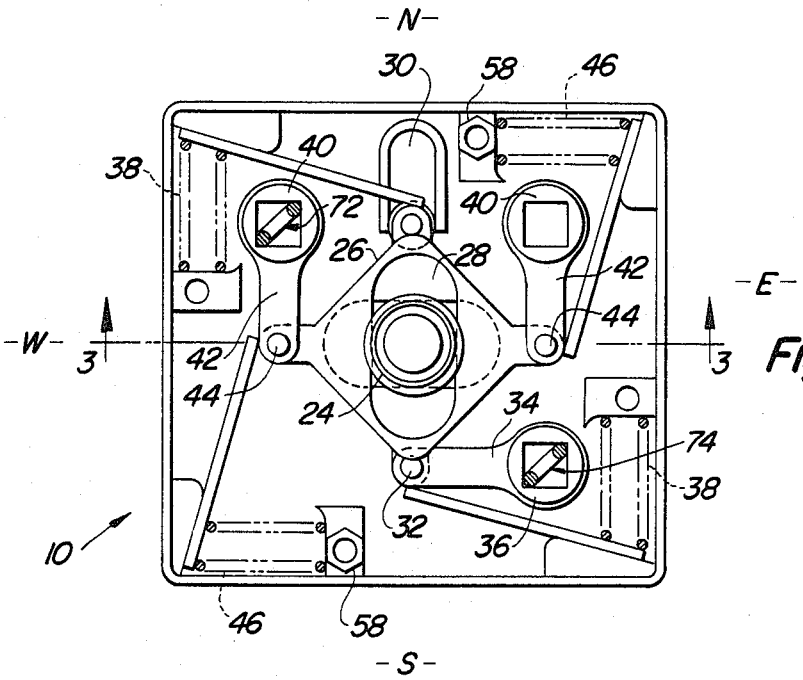
FIG. 2 is a bottom plan of the joy-stick unit as seen generally along the line 2—2 of FIG. 1, but FIG. 2 is rotated 90 degrees clockwise (as seen from above) relative to FIG. 1.

As best seen in FIGS. 2 and 3, the lever has a lower end portion that depends below the ball mounting and is provided with a bearing ring (24) which in turn is received in slotted slides (26) and (28). The slots in the plates are at right angles to each other and the plates are appropriately guided for independent movement; that is, so that N-S movement of one plate does not affect the position of the other. For example, in the present case, the lower plate is guided at one corner by roller and slot means (30) and is linked at its diagonally opposite corner at (32) to an arm (34) for a driving member (36) mounted in the base in any suitable manner for back and forth movement about a vertical axis. Opposed biasing means (38) act to center the plate in the position shown in FIG. 2 with the lever (20) centered in its upright position. According to the particular joy-stick unit selected for illustration, a pair of other driving members (40), similar to the member (36), is mounted in the base on vertical axes. Each of these members has an integral arm (42) connected at (44) to diagonally opposite corners of the plate (26). The combination of the slot in the plate (28) and the connections at (44) guides the plate (26) for movement in a linear path normal to the linear path in which the other plate is guided. In other words, the plate (26) is guided for E-W movement as distinguished from the N-S movement of the plate (28). Movement of the plate (26) causes limited turning of the driving members (40) independently of the driving member (36). Diagonally opposed second biasing means (46) serve to center the plate (26).

From the description thus far, it will be seen that N-S rocking of the joy-stick lever causes S-N movement of the plate (28) and hence back and forth limited turning of the element (36); similarly, E-W movement of the lever operates the driving members (40); and diagonal movement of the lever will result in movement of both plates and their respective driving members.

As already indicated, the control is oriented for arrangement and operation in a situation in which the lever (20) is normally upright. Further characteristics of the structure and operation of the related components will, for ease in understanding the invention, be described in terms of the same orientation, it being understood of course that the control may be mounted otherwise.

A mounting element or bracket (48) of any suitable material is disposed below the unit (10) and is of inverted U-shape, having a top or bight (50) and opposite upright wall portions (52) and (54). The arrangement of this element below the base unit (10) is 45 degrees out of phase with the base unit, for purposes to presently appear, that is, although both components are essentially square in plan, the mounting element is diagonal rather than congruent or almost-congruent as respects the base unit. The element is affixed to the bottom of the base unit by means of a pair of screws (56) and base-mounted vertical spacers (58), only one of each being shown in FIGS. 1 and 3 but the presence of both spacers being evident in FIG. 2. The wall portion (52) has therein upper and lower somewhat rectangular openings (60) and a similar pair of openings (62) is provided in the other wall portion. A first rocker switch (64) is mounted by screws (66) to the wall portion (52), being accommodated in the opening (60), and a similar rocker switch (68) is mounted in the other wall portion via screws (70) and occupies the lower opening (62). Thus the rocker switches extend toward each other and into the mounting element but are vertically offset or overlapped so as not to interfere with each other and at the same time minimizing laterally outward projection. The rocker switches are typical of known electrical switches and description of details thereof need not be resorted to. Suffice it to say that each includes a double-faced rocker whose rocking axis is coaxial with the respective driving member of the base unit. That is to say, the axis of the switch (64) is coaxial with the one driving member (40) in the base unit (the other member (40) is not used); and the axis of the other switch (68) is coaxial with the other driving element (36). In other words, the rocker switch (64) is the E-W switch and the switch (68) is the N-S switch. As is typical of rocker switches of this type, each has a central neutral or "off" position and each is rockable to either side of and return to that off position, as for causing, say, forward and reverse of some remote instrumentality, (e.g., electrical motor) while the other switch may function to achieve right and left, fast and slow, etc.

The invention features novel means for actuating the rocker switches according to movement of the lever (20). For this purpose, there are provided two identical driven members identified as (72) and (74). These perform separate but similar functions and are arranged as mirror images of each other in the total assembly. The member (72) may be conveniently referred to having somewhat the shape of a hairpin, having an upper bight (76) and a pair of legs (78). The under portion of the E-W driving element (40) in the base unit is in the form of a square socket and the bight of the hairpin is designed to fit diagonally into the square and thus to establish a driving connection so that turning of the member (40) will be imparted to the hairpin. The legs (78) are offset laterally outwardly at (80) to provide lever arms as well as to accommodate a lateral offset of the associated wall portion relative to the driving member (40), and the prolongations of the legs lie along and engage the faces of the associated rocker switch. Just below this switch, the legs are bent back laterally inwardly and have terminal ends (82) received in apertures (84) formed in a ledge (86) integral with a lower part of the associated wall portion (52). The hairpin is of spring steel wire or the like. Since the terminal ends are anchored at the ledge (86), turning of the driving member (40) twists the hairpin one way or another to rock the switch one way or the other. In addition to the bight being rather firmly received in the socketed driving element (40), the offset portions (80) can engage the adjacent upper edge portion of the mounting element top and prevent downward dislodging of the hairpin. The terminal ends being received by the holes in the ledge (86) retain the hairpin against dislodgement otherwise. The resiliency of the hairpin plus whatever biasing means is present in the switch (64), together with the base unit biasing means (46) assures return of the switch to neutral when the lever (20) is returned to its central position.

The construction and mounting of the other hairpin (74) is similar to the characteristics of the hairpin (72). It has an upper bight portion (88) received in the square-socketed driving member (36) for N-S operation, as well as legs (90), an upper leg offset (92) comparable to that at (80) for the hairpin (72) as to shape and function, and offset terminal ends received in a perforated ledge (96) for the other wall portion (54). In short, the two hairpins are shaped and function alike as will be seen without further description. It will be readily seen from the lower part of FIG. 1, that the assembly including the mounting element (48), rocker switches and mounted hairpins forms a unit that is easily attached to the joy-stick unit from below the upstanding bight portions of the hairpins being "plugged into" the respective socketed members (36) and (40), after which the screws (56) are positioned and tightened into the spacers (58) which have been previously affixed to the bottom of the base unit.

Going back to the diagonal relation between the square shapes of the base unit and mounting element, the reason for this is best seen in FIG. 2 where it is clear that the upper ends of the hairpins (72) and (74) are diagonally related whereas these hairpins are directly across from each other in FIG. 1. The selection of the diagonally related driving members (36) and (40) allows maximum space for the rocker switches and their convenient and compact arrangement in the mounting element. The hairpin construction is simple to produce and the material is selected for long life.

Features and advantages other than those specifically pointed out will occur to those versed in the art, as will many modifications in the preferred embodiment disclosed.

We claim:

1. In a multi-directional control apparatus including a base having a top and a bottom, first and second separate driving members carried by the base for back and forth rocking respectively about first and second vertical axes and exposed at the bottom of the base and a joy-stick carried by and projecting above the top of the base and connected to the driving members for back and forth rocking of one member in response to back-and-forth movement of the joy-stick in a first path and for back and forth rocking of the other member in response to back and forth movement of the joy-stick in a second path normal to the first path, the improvement comprising a mounting element of inverted U-shape having a top affixed to the base bottom and further having first and second wall portions rigid with and depending from the top, first and second rocker switches carried respectively by the wall portions respectively directly below the first and second driving members for rocking to opposite sides of and return to neutral status, and first and second driven members connected respectively at their upper ends to the first and second driving members and depending in parallelism respectively to and respectively engaging the rocker switches for selective operation of said switches according to movement of the joy-stick.

2. In the central apparatus according to claim 1, in which each rocker switch has a rocking axis coaxial with the associated driving member.

3. In the control apparatus according to claim 2, in which each driven member is of generally hairpin shape, having an upper end in the form of a bight received by the associated driving member and a pair of integral legs depending alongside the associated rocker switch in straddling relation to that rocker switch axis.

4. In the control apparatus according to claim 3, in which each driven member leg has a terminal end portion depending below the associated rocker switch and secured to the associated mounting element wall portion, each driven member being of resilient material to yield to movement of its driving member and to recover its original status upon return of its rocker switch to its neutral status.

5. In the control apparatus according to claim 4, in which each mounting element wall portion has a lower ledge portion for receiving the terminal ends of the respective driven member.

6. In the control apparatus according to claim 5, in which each ledge portion has a pair of apertures therein respectively receiving the terminal ends of the associated member legs.

7. In the control apparatus according to claim 1, in which each mounting element wall portion has an opening therein and each rocker switch is mounted at least in part within the associated opening.

8. In the control apparatus according to claim 7, in which the rocker switches are vertically offset with respect to each other and extend inwardly from their respective mounting element wall portions in horizontally overlapping relation.

9. In the control apparatus according to claim 1, in which the mounting element wall portions are offset respectively laterally outwardly of the driving members and each driven member includes a lateral offset accommodating the offset of the associated wall portion.

10. In the control apparatus according to claim 9, in which the axis of each rocker switch is coaxial with its respective driven member and each rocker switch further has outwardly disposed faces engaged by the respective driven member below the offset of said member.

* * * * *